United States Patent [19]

Mildren

[11] 4,426,048

[45] Jan. 17, 1984

[54] STABILIZING A ROTATING BODY

[75] Inventor: Michael T. Mildren, St. Peters, Australia

[73] Assignee: The Commonwealth of Australia, Canberra, Australia

[21] Appl. No.: 303,503

[22] Filed: Sep. 18, 1981

[30] Foreign Application Priority Data

Sep. 22, 1980 [AU] Australia ..... PE5681

[51] Int. Cl.[3] ..... F42B 15/14

[52] U.S. Cl. ..... 244/3.23

[58] Field of Search ..... 244/3.15, 3.16, 3.2, 244/3.23, 3.24; 102/208, 209

[56] References Cited

U.S. PATENT DOCUMENTS

| | | | |
|---|---|---|---|
| 3,111,088 | 11/1963 | Fisk | 244/3.23 |
| 3,297,948 | 1/1967 | Kohler | 244/3.23 |
| 4,193,567 | 3/1980 | McCarty, Jr. | 244/3.16 |

*Primary Examiner*—Donald P. Walsh
*Assistant Examiner*—Maureen T. Ryan
*Attorney, Agent, or Firm*—Cushman, Darby & Cushman

[57] ABSTRACT

A system of stabilizing a platform in relation to a body with relative spin therebetween wherein the body rotation is measured in relation to a fixed datum such as a gravity sensor and the platform rotation is measured in relation to the body by means such as a photocell in the body and a mirror in the platform, and relative spin is corrected by means such as a motor located in the body to drive the platform.

7 Claims, 3 Drawing Figures

STABILIZING A ROTATING BODY

Figure 1:
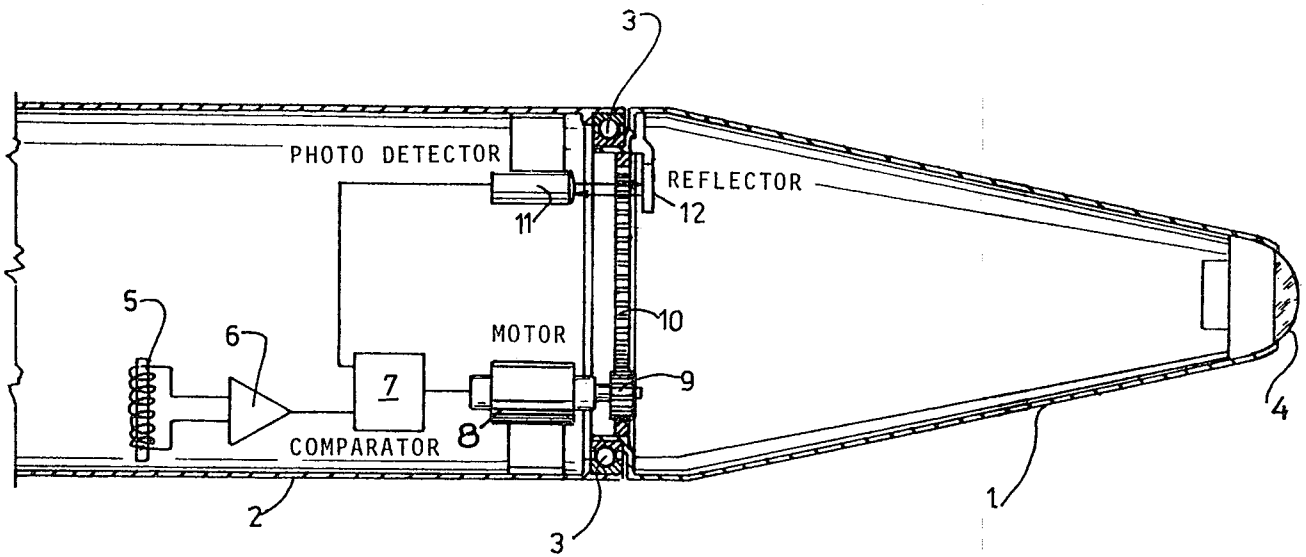

This invention relates to a method of and means for stabilising a platform on a moving body.

It is already known from the specification of U.S. Pat. No. 3,437,288, DO MAU LAM, to provide a device for stabilising a body about an axis which is not the axis of symmetry by applying calculated and timed torque impulses so as to change an existing rotation to rotating about a new axis up to 10° away, the device including a sophisticated electronic control unit to achieve this.

It is also known from the specification of U.S. Pat. No. 3,442,468, ANTHONY J. IORILLO, to de-spin one body in relation to another coupled body where one body is a non-rigid rotor and the other is a de-spun platform, the rotor supporting elements such as nozzles to control precession or velocity, liquid containing tanks and the like. Nutational stability of the device is achieved by the non-rigid body so that the de-spun body opposes nutation by dissipating energy.

It is known from the specification of U.S. Pat. No. 3,180,587, H. D. GARNER et al to use a motor in the body of an aerospace vehicle to drive a star seeker for orientation purposes, using a slip ring between the seeker and the body, but slip rings and other mechanical devices tend to be unreliable.

The object of the invention is to provide a simple and effective device which will stabilise a platform in relation to a moving body.

The invention can be applied to a number of devices but according to one application the invention is applied to de-spin the nose section on a spin stabilised ballistic missile in which the nose-cone forms a platform containing a target-seeker and in which an unwanted component of motion is spun off the nose-cone in relation to spin of the body of the missile.

A further application is to stabilise a platform on a spin-stabilised satellite body having a platform with a free-fall experiment compartment where again the unwanted component is rotation of the compartment with the satellite.

A still further application is to stabilise a platform on an oceanographic research vessel where the platform supports an instrument package suspended above the ocean floor, which package must be stabilised against rise and fall due to waves and swell.

Another application is to stabilise a platform in the gun turret of a warship in which the transmitterreceiver must remain directed to the superstructure so as not to rotate with the turret.

The present invention comprises a body which generally forms the main structure which moves about a known axis relative to datum and has on it a platform which is movable on the body about a correcting axis about which the stabilisation is to occur, the stabilising mechanism, according to this invention, being mounted on or in the body itself but coupled to the platform to rotate the platform about the correcting axis, whereby to eliminate the need for rotating connections, such as slip rings between the body and platform.

Thus the invention comprises a method of stabilising a platform in relation to a body with relative spin therebetween, such as a nose section of a spin-stabilised ballistic missile, which consists in rotationally supporting the platform from the body about a spin-correcting axis, sensing the motion of the body about the said axis, driving the platform about the spin-correcting axis by drive means located on the body, sensing relative rotation of the platform and body, and controlling the drive means thereby.

According to a specific application the method is applied to a spinning missile having a rotating body and a relatively stable head wherein the sensing means comprise a spin rate sensor in the body and a photo device also in the body, the method consisting in directing the photo device to a reflector in the head, and correlating the signal from the spin rate sensor and the signal from the photo device to control the drive means to adjust the relative rate of rotation between the head and body.

The device can conveniently comprise a body, a platform rotationally connected to the body about a spin-correcting axis, drive means supported by the body and coupled to the platform to apply relative rotation between the head and platform, spin rate sensing means in the body to measure rotation of the body, relative rotation-sensing means between the body and platform also supported by the body, and means to control the drive means from the sensing means.

The invention thus achieves a simplified device in which drive means are merely required between the body and the platform, in which also the drive means and the stabilising sensors can form a neat package in or on the body, which package includes the driving means and the mechanism which controls the driving means and the means which transmits the drive to drive-receiving means on the platform.

Figure 2:
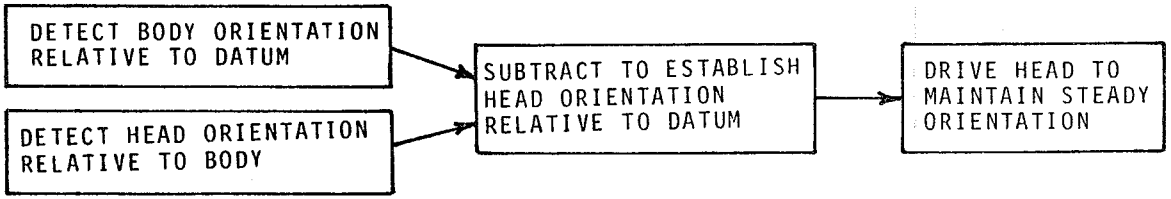
Figure 3:
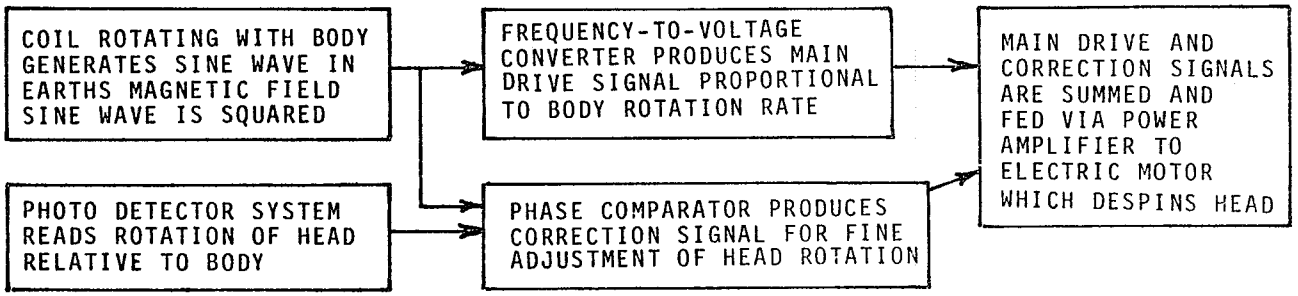

In order however that the invention may be more fully understood, an embodiment thereof will now be described with reference to the accompanying drawings in which:

FIG. 1 is a central longitudinal section of a missile showing part only of the body, and showing the head and its supporting and control mechanism, FIG. 2 is a block diagram showing the general technique, and FIG. 3 is a block diagram showing how the technique may be applied.

According to the form shown the invention is applied to a missile with a controlled nose cone platform 1, rotationally mounted on the spinning body 2 of the missile, a ball race 3 mounted on the body forming the connection which allows the platform 1 to be de-spun. This mounting could be replaced by a shaft on the head engaging a bearing in the body. The platform 1 contains target-seeking detectors 4. A magnetometer coil 5 rotates with the body 2 in the earth's magnetic field to produce a sinewave voltage at a frequency synchronous with the body spin rate. This signal is amplified by a suitable amplifier 6 and is fed to a comparator 7 which produces the signal to control the drive motor 8.

The motor 8 drives the platform through a pinion 9 engaging a ring gear 10 on the platform 1, the platform being driven in the opposite direction to the body spin. A photo-detector 11 in the body 2 is directed at a reflector 12 in the platform 1 to produce a pulse train at a frequency synchronous with the rate of rotation of the platform relative to body, and feeds it to the comparator 7.

The comparator 7 is adjusted to deliver correct power to the motor 8 when the head-relative-to-body rate, which is sensed by the photo-detector 11 and mirror 12 matches the body-relative-to-earth rate which is sensed by the magnetometer coil 5; more if the platform/body rate falls, and less if it rises.

While in the above described embodiment a magnetometer is used to sense body roll in the earth's magnetic field, other devices can be used depending on the medium in which the body operates and the type of sensing required, and for instance in the satellite used in the solar system a photocell rotating in and out of sunlight can be used, while in the oceanographic research vessel, accelerometers form a convenient sensing means. In the gun turret application the angle of the ship is sensed with synchro means between ship and turret.

From the foregoing it will be realised that the invention basically comprises a system of rotationally controlling a platform carried by a body about a control axis, by means mounted on or in the body which itself goes through controlled or uncontrolled motions, by means which engage drive-receiving means in the platform, the body carrying the motion-sensing device and the drive motor mechanism and what can be referred to as remote rotation sensing means between the platform and the body such as the photocell and mirror means described in relation to the missile or other beam projecting or prosecuting means which require no mechanical connection between the platform and the body.

I claim:

1. The method of stabilising a platform in relation to a body with relative spin therebetween, comprising rotationally supporting the platform from the body about a spin-correcting axis, sensing the motion of the body about the said axis and generating a signal proportional to such motion, driving the platform about the spin-correcting axis, sensing relative rotation of the platform and body and generating a signal proportional to such rotation, and controlling the drive in accordance with said signals.

2. The method of claim 1 applied to a spinning missile having a rotating body and a relatively stable head wherein the step of sensing the relative rotation of the platform and body and generating a signal proportional thereto includes directing a light beam from the body to a reflector carried by the head and generating a pulse train synchronous with the rate of rotation of the platform relative to the body, and correlating the signal proportional to motion of the body about said axis and the pulse train to control the drive to adjust the relative rate of rotation between the head and body.

3. The method of claim 2 in which the step of sensing the motion of the body about said axis includes generating a sinewave from rotation of the said body, squaring the sinewave, feeding the squared sinewave to a frequency converter to produce a main drive signal, feeding the pulse train signal to a phase comparator while at the same time also feeding the squared wave thereto to provide a correction signal for fine adjustment of platform rotation, summing the signal from the said frequency converter and the signal from said comparator to a summing signal, and driving the platform in accordance with said summing signal.

4. A device for stabilising a rotating body wherein a body supports a platform characterised by means rotationally connecting the platform to the body about a spin-correcting axis, drive means supported by the body and coupled to the platform to apply relative rotation between the said platform and the said body, sensing means in the body to measure rotation of the body about the spin-correcting axis, relative rotation sensing means between the body and platform also supported by the body to remotely sense the said relative rotation, and means to control a drive motor from both said sensing means.

5. A device according to claim 4 wherein the said sensing means for spin-correction of the body is a magnetometer coupled through an amplifier which connects to a comparator which controls the said drive means.

6. A device according to claim 4 wherein the relative rotation between the said body and the said platform are sensed by a photocell in the said body directed to a reflector in the said platform, said photocell being coupled to a comparator which controls the said drive means.

7. A device according to claim 4 wherein the spin of the body is sensed by means in the body producing a sinewave, and the rotation between the platform and the body is sensed by means in the body pulsed by the rotation of the platform, and where in the electrical circuitry comprises means to square the said sinewave, a frequency converter to receive the said squared signal, a phase comparator to simultaneously receive the said squared signal, means to feed also the said pulsed signal resultant from the relative rotation between platform and body to the said phase comparator, a summing circuit to receive the signal from the said frequency converter and the said comparator, and means to amplify the output signal from the comparator to drive the said motor.

* * * * *